US007571834B2

(12) United States Patent
Hopkins et al.

(10) Patent No.: US 7,571,834 B2
(45) Date of Patent: Aug. 11, 2009

(54) MAGAZINE FOR AUTOMATIC FEED BLIND RIVET SETTING TOOL

(75) Inventors: James Hopkins, Venice, FL (US); Dallas B. Perkins, Seminole, FL (US)

(73) Assignee: Sartam Industries, Inc., Venice, FL (US)

( * ) Notice: Subject to any disclaimer, the term of this patent is extended or adjusted under 35 U.S.C. 154(b) by 818 days.

(21) Appl. No.: 10/951,293

(22) Filed: Sep. 27, 2004

(65) Prior Publication Data

US 2006/0102648 A1 May 18, 2006

(51) Int. Cl.
*G07F 16/00* (2006.01)

(52) U.S. Cl. ..... 221/279; 221/198; 221/136; 221/120; 72/391.6

(58) Field of Classification Search ..... 221/279, 221/198, 136, 120; 72/391.6; 29/243.525
See application file for complete search history.

(56) References Cited

U.S. PATENT DOCUMENTS 4,127,954 A * 12/1978 Hausmann ..... 42/50
5,184,497 A * 2/1993 Hanlon et al. ..... 72/391.6
5,335,800 A * 8/1994 Liu ..... 221/279
5,666,710 A * 9/1997 Weber et al. ..... 29/243.523
6,098,442 A * 8/2000 Walldorf et al. ..... 72/391.6
6,301,948 B1 * 10/2001 Weiland ..... 72/391.6
7,076,866 B2 * 7/2006 Iannucci ..... 29/809
7,347,078 B1 * 3/2008 Hopkins et al. ..... 72/391.6

* cited by examiner

*Primary Examiner*—Patrick Mackey
*Assistant Examiner*—Michael E. Butler
(74) *Attorney, Agent, or Firm*—Charles J. Prescott

(57) ABSTRACT

A magazine for holding a quantity of blind rivets ready for use in an automatic rivet setting tool. The rivets are connected together in spaced relation along the length of an elongated rivet carrying strip or ribbon of flexible material by having a distal portion of each mandrel inserted or pierced therethrough. The magazine includes longitudinal panels connected together in a preferably even, spaced, radially extending arrangement forming a spool. The longitudinal panels each define an outer distal longitudinal edge, all of which are preferably substantially parallel one to another and to a central spool axis. Each rivet carried on the flexible strip, when the flexible strip is spiral-wound around said longitudinal distal edges, is positioned in somewhat radially oriented fashion between adjacent longitudinal panels with the head of each rivet positioned inwardly toward the spool axis.

9 Claims, 15 Drawing Sheets

MAGAZINE FOR AUTOMATIC FEED BLIND RIVET SETTING TOOL

STATEMENT REGARDING FEDERALLY SPONSORED RESEARCH OR DEVELOPMENT

Not applicable

CROSS-REFERENCE TO RELATED APPLICATIONS

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to automatic riveting devices, and more particularly to a rivet magazine for an automatic feed blind or pop-rivet setting device.

2. Description of Related Art

Considerable technological effort has been expended in developing blind or pop or mandrel-type rivets, hereinafter collectively referred to as blind rivets, and the associated manually operated devices for setting such rivets. The primary requirement for setting blind rivets is to support the enlarged flange of the rivet body against an anvil or rivet table with the rivet body inserted through a closely mating hole in a work surface. The mandrel extends axially through the rivet table and is gripped by jaws which tension and pull the mandrel rearwardly, expanding the body of the rivet to a point where the mandrel is fractured away. Thus, blind rivets are particularly useful in situations where a conventional riveting tool does not have access to both sides of the working surfaces to be rivet-connected together.

What appears to be a second stage in the development of blind rivets has been toward the automatic setting of the rivet wherein a source of power such as a motor, a pneumatic actuator or hydraulics are utilized to replace manual effort in expanding and setting the rivet through mandrel pull.

This riveting technology has also expanded into the development of automatic riveting devices which include an automatic feed means for the rivets themselves. Prior to such development, the user has been required to manually insert each fresh rivet into the rivet table one at a time. Because these devices still require the user to depress an actuator or trigger to set each rivet, these devices are referred to as "semi-automatic" rivet machines having an automatic feed.

The bulk of these automatic feed rivet devices fall generally into two categories. The first category is one wherein the nosepiece and/or rivet table is pivotally or arcuately connected wherein these components swing apart radially outwardly from one another so that a new rivet may be passed forward longitudinally from behind this arrangement into position, whereupon the nosepiece and/or rivet table components are closed around the rivet body and mandrel with the flange of the rivet against the distal end surface of the rivet table.

The second general category of automatic rivet feed means is directed to an external arm arrangement which swings or pivots a fresh rivet into coaxial alignment forwardly of the rivet anvil and then either automatically draws or allows the rivet to be manually moved rearwardly wherein the mandrel enters the longitudinal aperture of the rivet anvil.

Despite this considerable effort and incentive in developing such an automatic feed rivet setting device, only one such machine has successfully been marketed and is disclosed in U.S. Pat. No. 5,136,873. A rivet magazine is also disclosed in U.S. Pat. No. 5,184,497.

The present invention provides an improved feed magazine for compactly holding a large quantity of blind rivets for such a rivet setting device, which in prototype and pre-production form, has operated successfully and reliably to date. This invention offers fully automatic rivet magazine feed means for an accompanying riveter which will set rivets automatically as quickly as an operator can act to position each new rivet head into another hole in the work surface and activate the riveter.

BRIEF SUMMARY OF THE INVENTION

This invention is directed to an improved one-piece magazine for compactly holding and feeding therefrom a quantity of blind rivets to a blind rivet setting device which automatically feeds blind rivets into a specially designed rivet table, then sets the rivet by pulling and detaching the mandrel. The magazine holds a thin elongated strip or ribbon of flexible material which holds and grips the mandrel tips pierced through the strip in evenly spaced apart fashion. The strip, spiral wound on the magazine, is drawn from the magazine into a feed slot formed transversely through a rivet table of the rivet setting device generally transverse to the longitudinal axis of the riveter. A spring biased retracting device may be used to continuously pull the strip through the feed slot so that the next rivet in succession facing the rivet table is automatically drawn into axial alignment within the rivet table ready for positioning and setting into a work surface.

It is therefore an object of this invention to provide an improved magazine for grippingly holding a quantity of rivets for automatic feed into an automatic rivet setting device for setting blind rivets which includes an automatic rivet feed arrangement.

It is still another object of this invention to provide an improved economically manufactured one-piece magazine for holding a quantity of rivets as part of an automatic blind rivet feed arrangement for riveting devices.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 1 is a perspective view of a fully assembled prior art magazine utilized with the semi-automatic rivet setting tool as disclosed in U.S. Pat. No. 5,136,873.

DETAILED DESCRIPTION OF THE INVENTION

Prior Art

The complete specification and drawings disclosed in U.S. Pat. No. 5,184,497 have been previously incorporated by reference and are repeated herein.

Figure 1:
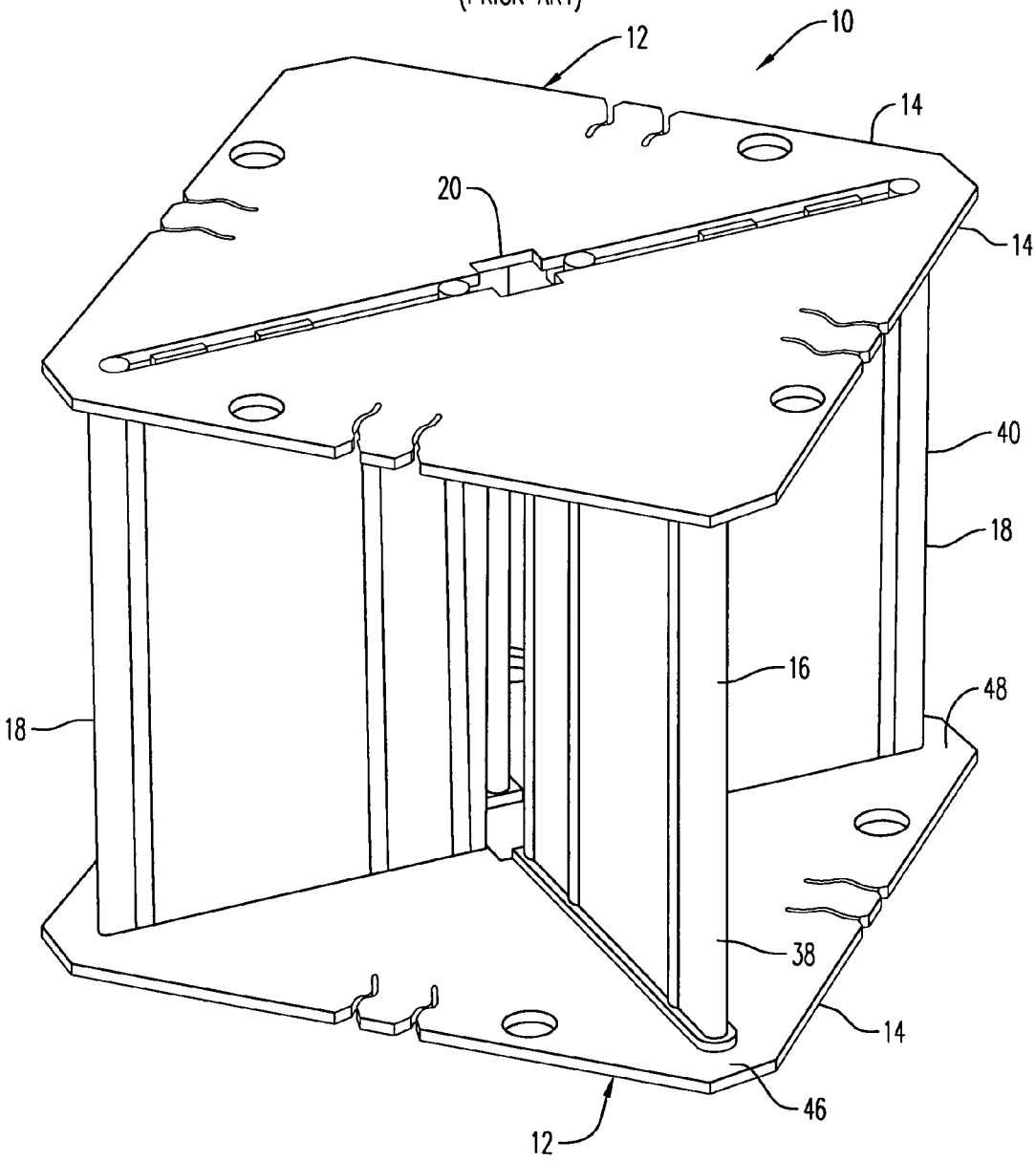
FIG. 1 (PRIOR ART)
Figure 2:
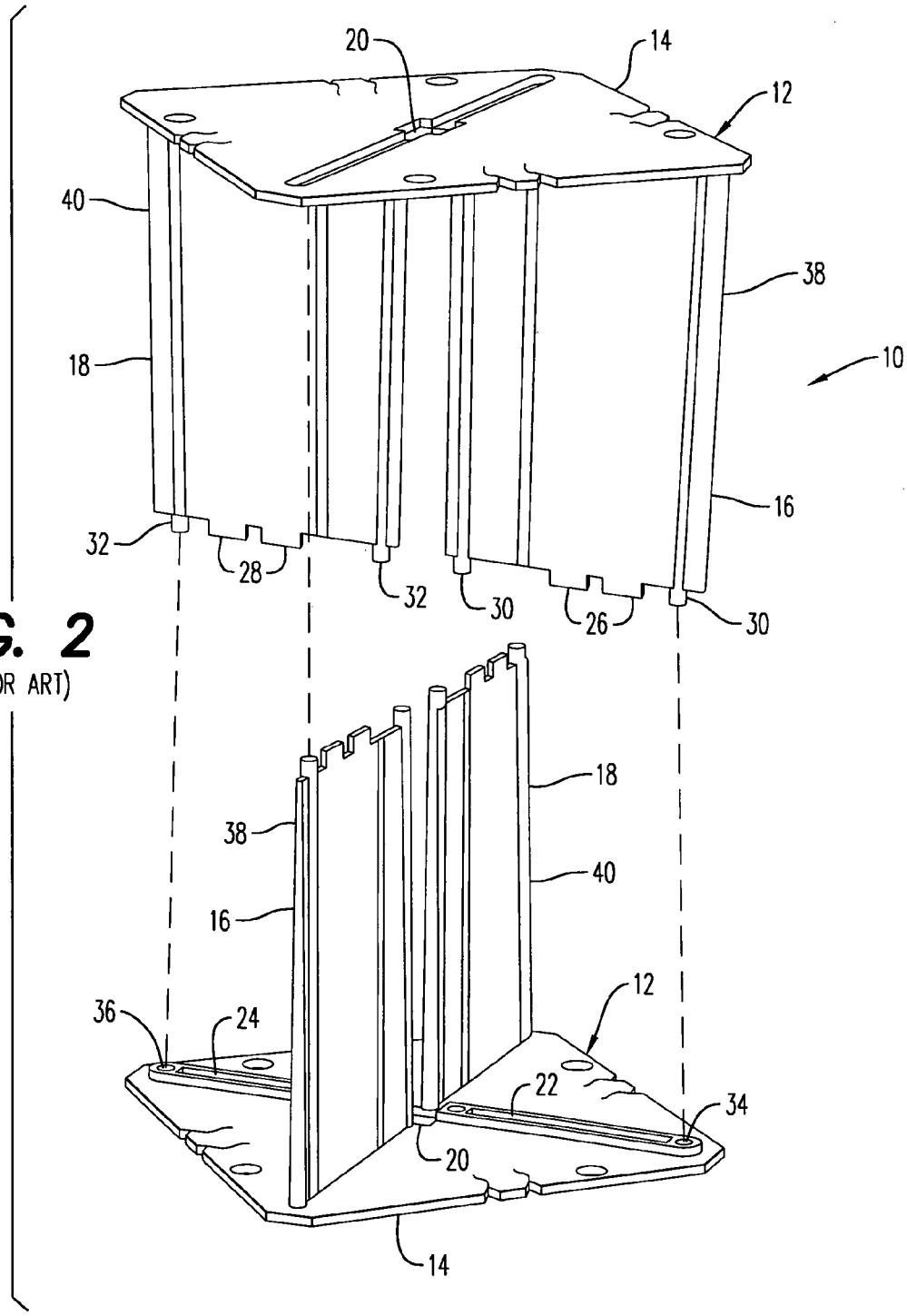
FIG. 2 (PRIOR ART)
FIG. 2 is an exploded view of the two-part magazine shown in FIG. 1.

Referring firstly to FIGS. 1 and 2, a prior art magazine is there shown generally at numeral 10 and includes two identical mating magazine halves 12 shown in FIG. 2 which mating engage together to form the magazine 10. Each of the magazine halves 12 includes radially extending longitudinal panels 16 and 18 which are oriented in spaced apart radially extending coplanar fashion and formed at a proximal end thereof with a rectangular transversely oriented end plate 14. Each end plate 14 includes a central drive aperture 20 which is operably engageable onto a rotatable support and drive spindle (not shown). The distal ends of each longitudinal panel 16 and 18, respectively, include locking tabs 26 and 28 and locator pins 30 and 32, respectively, which align and lockingly engage into cavities 22 and 24 and locator holes 34 and 36, respectively, formed on the inner surface of each of the end plates 14.

Figure 17:
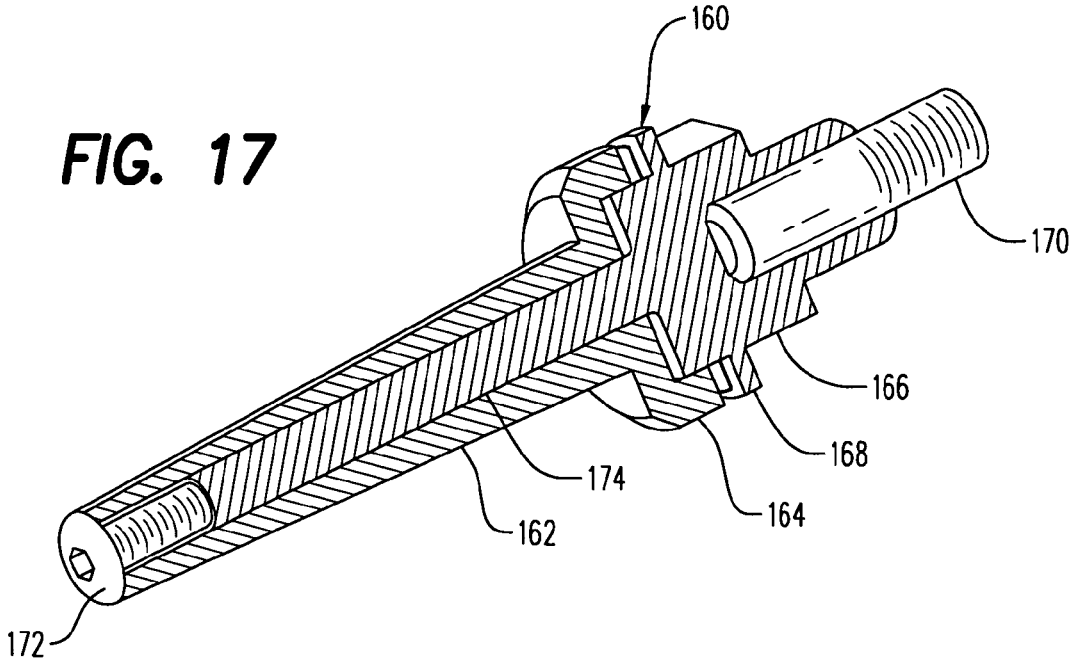
FIG. 17 is a longitudinal section view of FIG. 16.

When assembled, a length of flexible MYLAR or plastic strip or ribbon carrying spaced apart rivets as disclosed in the '497 patent are windingly engageable around the outer distal longitudinal edges or margins 38 and 40 of each of the longitudinal panels 16 and 18, respectively, and in the same orientation of rivet heads inward and shanks outward as shown in FIGS. 17 and 18 of the '497 patent. The end plates overhang the distal longitudinal edges 38 and 40 at 46 and 48, respectively.

The Invention

Figure 3:
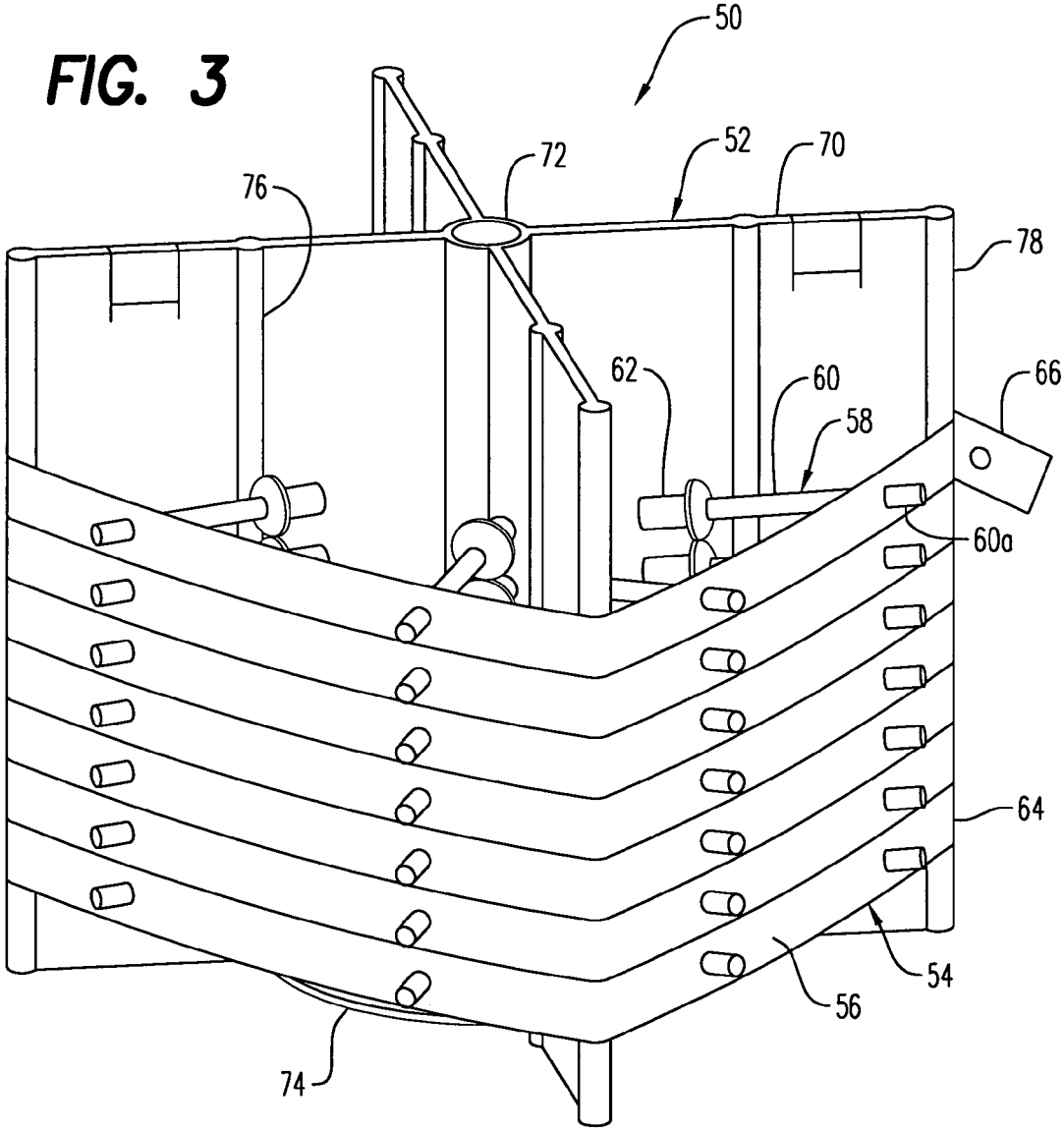
FIG. 3 is a perspective view of one embodiment of the improved magazine of the present invention holding a quantity of rivets each held by an elongated strip of flexible material.
Figure 4A:
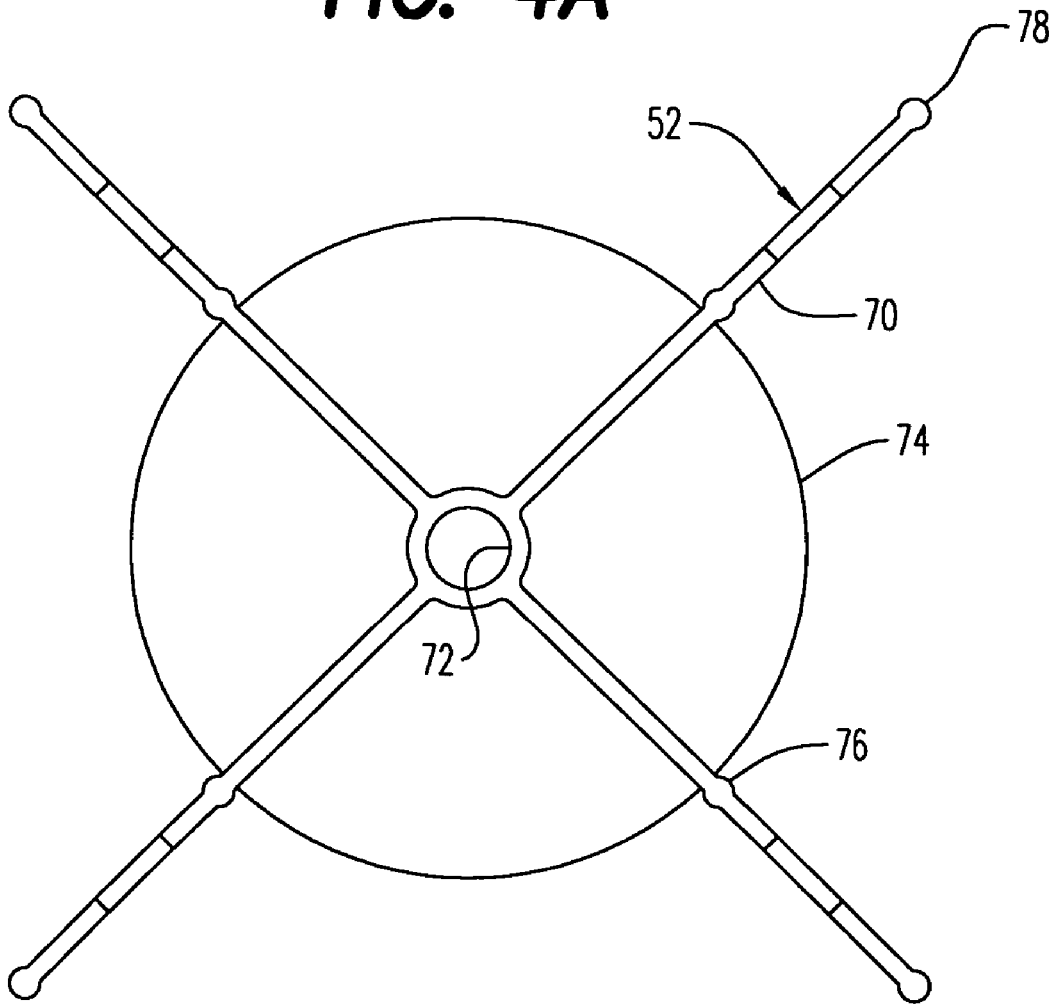
FIG. 4A is a top plan view of the improved magazine of FIG. 3 absent the rivets and flexible rivet carrying strip.
Figure 4B:
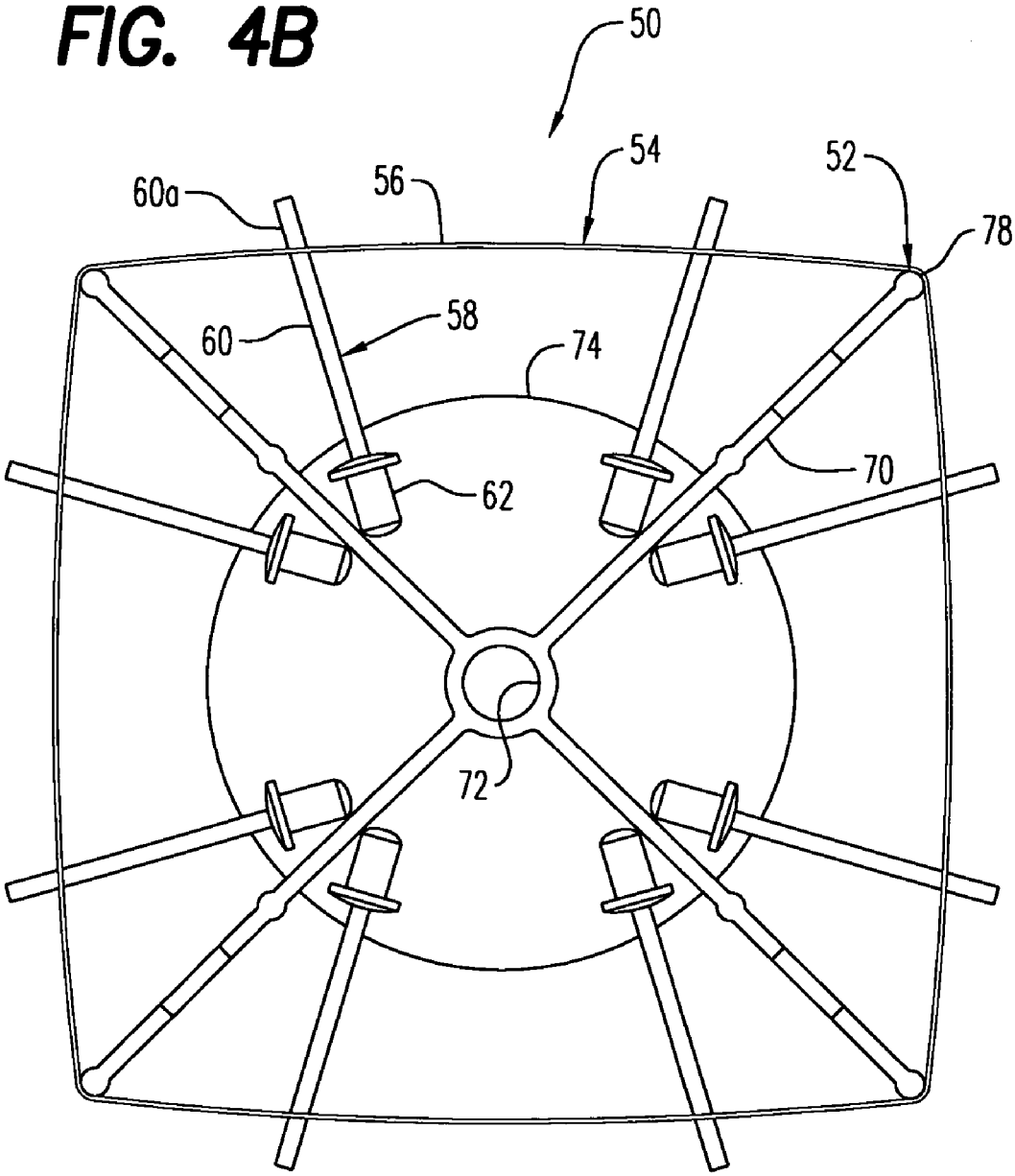
FIG. 4B is a top plan view of FIG. 3 including the rivets and flexible rivet carrying strip.
Figure 5:
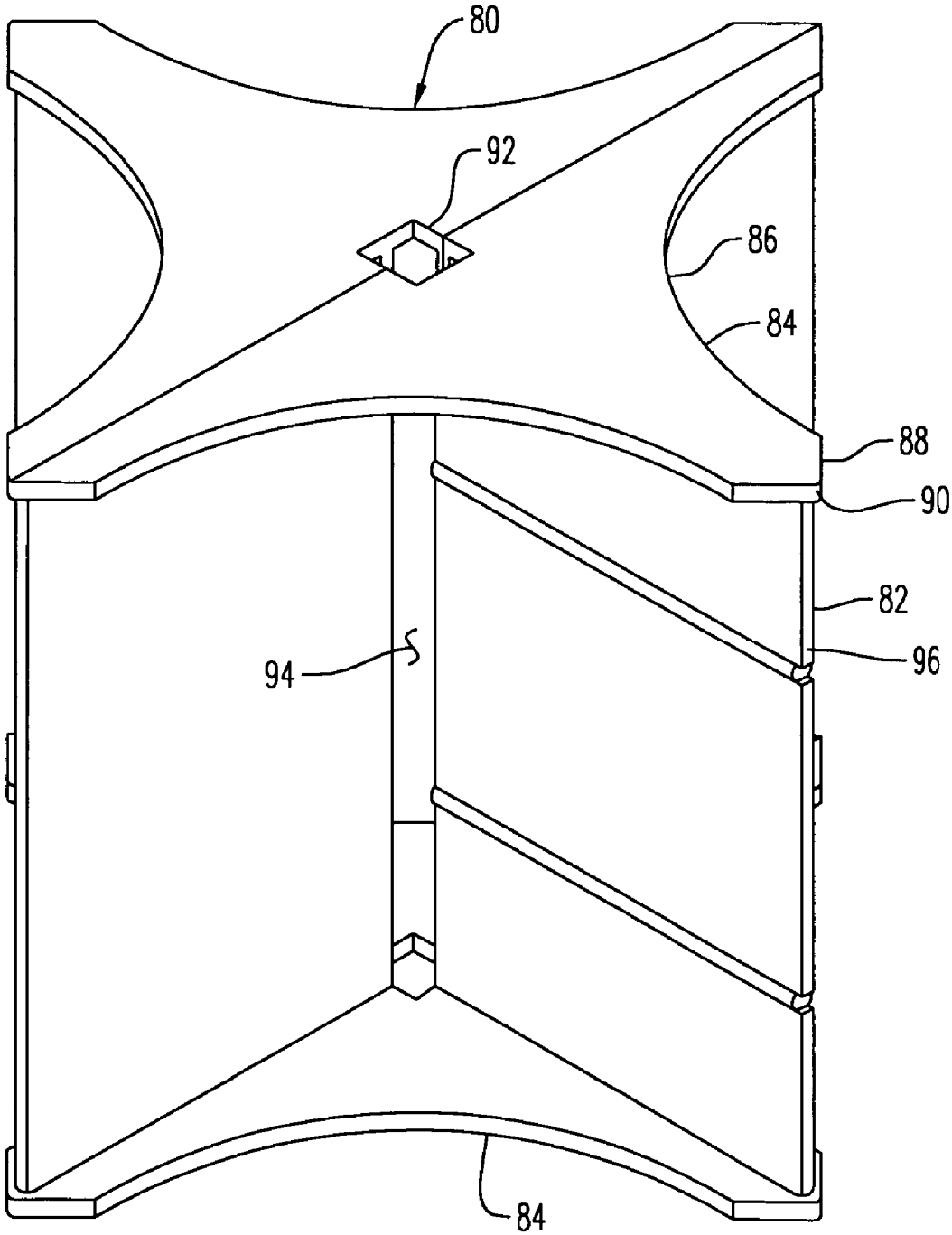
FIG. 5 is a perspective view of another embodiment of the magazine invention.

Referring now to FIGS. 3, 4A and 4B, one embodiment of the present invention is there shown generally at numeral 50 and includes a uniquely configured magazine 52 and a loaded flexible plastic or MYLAR rivet carrying strip 54 carrying a quantity of rivets 58 in evenly spaced relation therealong. The distal end portion 60*a* of each of the mandrels 60 of each rivet 58 is pierced through the flexible plastic strip 56 which is of sufficient strength and resiliency to retain the tip portion 60*a* of each of the rivets 58 in the position shown until such time as the carrying strip 56 delivers each rivet 58 into the prepared slot formed into the rivet table of the '497 rivet setting tool.

The magazine 52 is formed as a single unit of molded plastic and includes a central support passageway 72 for the mounting of the rivet magazine 52 onto a mating support or drive shaft either attached to a rivet setting tool (not shown) or a separate support. Each of the four longitudinal panels 70 includes stiffening ribs 76 and stiffened distal longitudinal edges 78 longitudinally extending therealong. An end plate 74 is disposed at one end of the magazine 52 to provide structural strength and stability for each of the longitudinal panels 70 and to provide some supportive assistance in preventing the heads 62 of the rivets 58 from falling outside of the end envelope of the rivet magazine 52.

However, because of the relative spacing along the flexible strip 56 of each of the mandrel end portions 60*a*, the rivet heads 62 each press against one of the longitudinal panels 70 thus acting together in pairs tipped inwardly as best seen in FIG. 4B to create a flexure of the flexible carrying strip 56 which has been wound taught around the longitudinal distal edges 78 of each of the longitudinal panels 70 starting at 64 and ending at 66. By this arrangement, a biasing effect is produced by the flexing of the tensioned flexible rivet carrying strip 56 which adds stability to the rivets 58 in place within the magazine 52.

Referring now to FIGS. 5 to 8, another embodiment of the magazine of the invention, the preferred embodiment, is there shown generally at numeral 80. This rivet magazine 80 includes four longitudinal panels 82 which extend longitudinally between transverse end panels 84. This embodiment 80, also formed as a unit, includes a central longitudinal passageway 94 and drive engaging apertures 92 formed in each of the end panels 84.

The peripheral edges of each end panel 84 are scalloped at 86 between corners 88 thereof and between each of the adjacent longitudinal panels 82 for weight reduction and rivet carrying strip loading and packaging convenience. The flexible strips loaded with rivets as previously described and shown in FIG. 3 are tightly spiral wound around the longitudinal distal edges 96 of each of the longitudinal panels 82 such that, even with the scalloped portions 86, each of the end panels 84 provide some support for retaining the heads 62 of each rivet 58 held by the tightly wound flexible rivet carrying strip within the envelope defined by the magazine 80.

Figure 6:
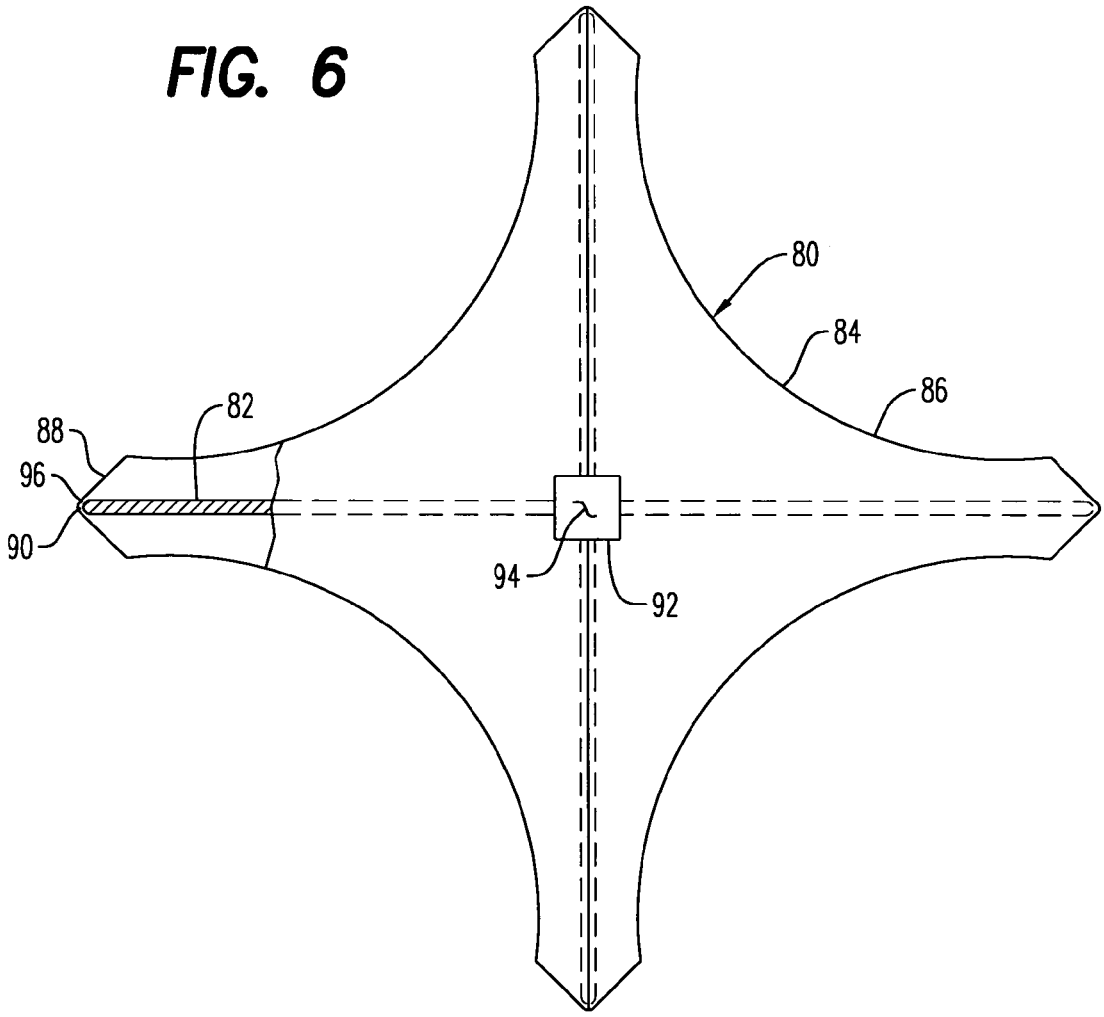
FIG. 6 is a top or bottom plan view of FIG. 5.
Figure 7:
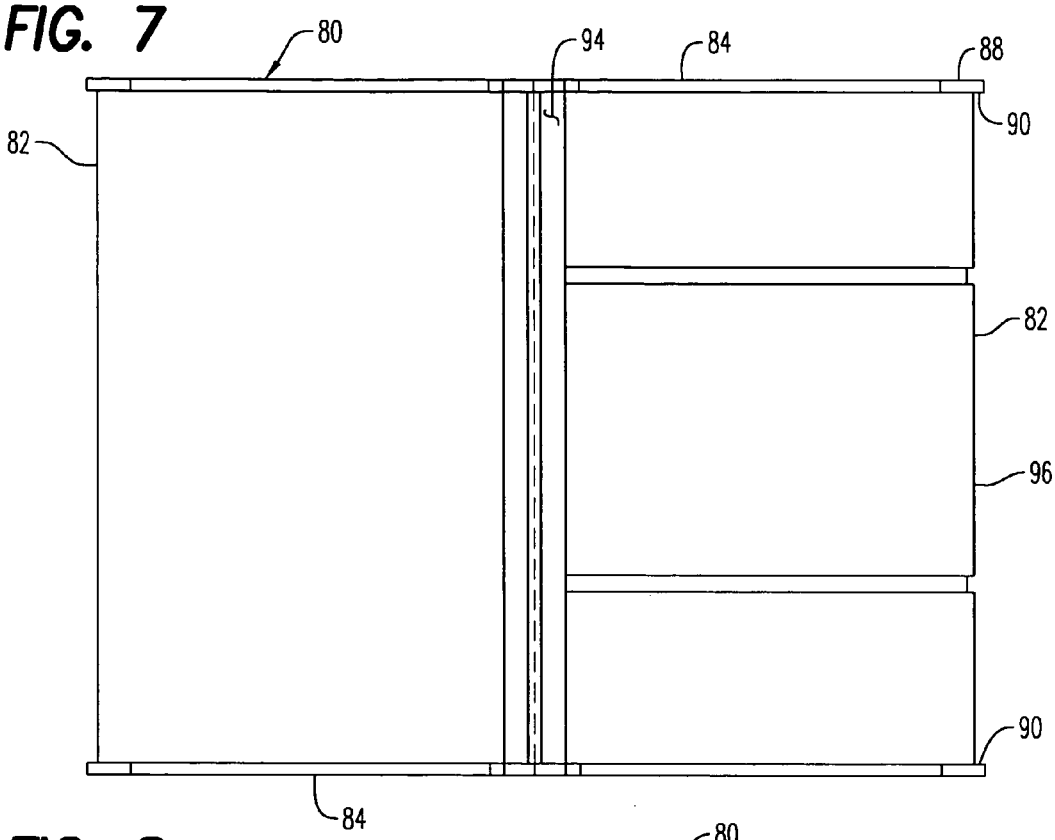
FIG. 7 is a front elevation view of FIG. 6.
Figure 8:
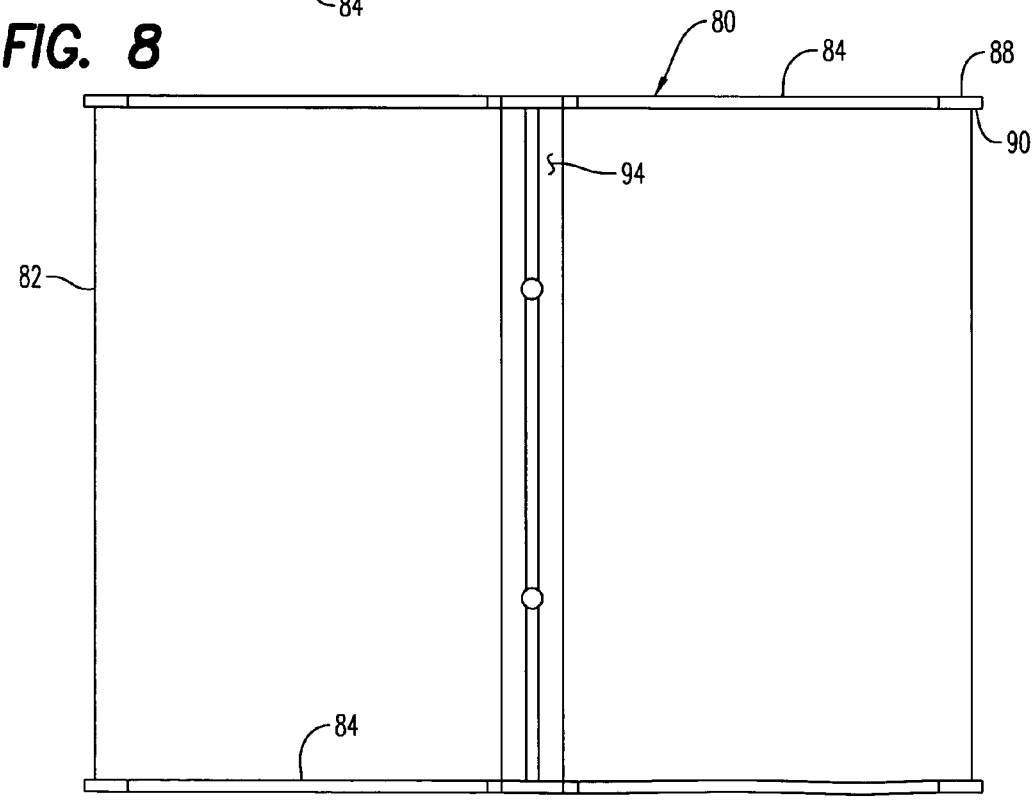
FIG. 8 is a side elevation view of FIG. 6.

To prevent the tightly wound flexible rivet carrying strip from inadvertently slipping off of the distal longitudinal edge 96 of one or more of the longitudinal panels 82, the tips or corners 88 of each of the end panels 84 extend radially outwardly beyond the distal edge of each longitudinal panel 82 as best seen in FIG. 6 at 90. Thus, when a fully loaded magazine is jostled or handled roughly, the flexible rivet carrying strip 56 is much less likely to inadvertently slip from the distal margins of each of the longitudinal panels 82.

Figure 9:
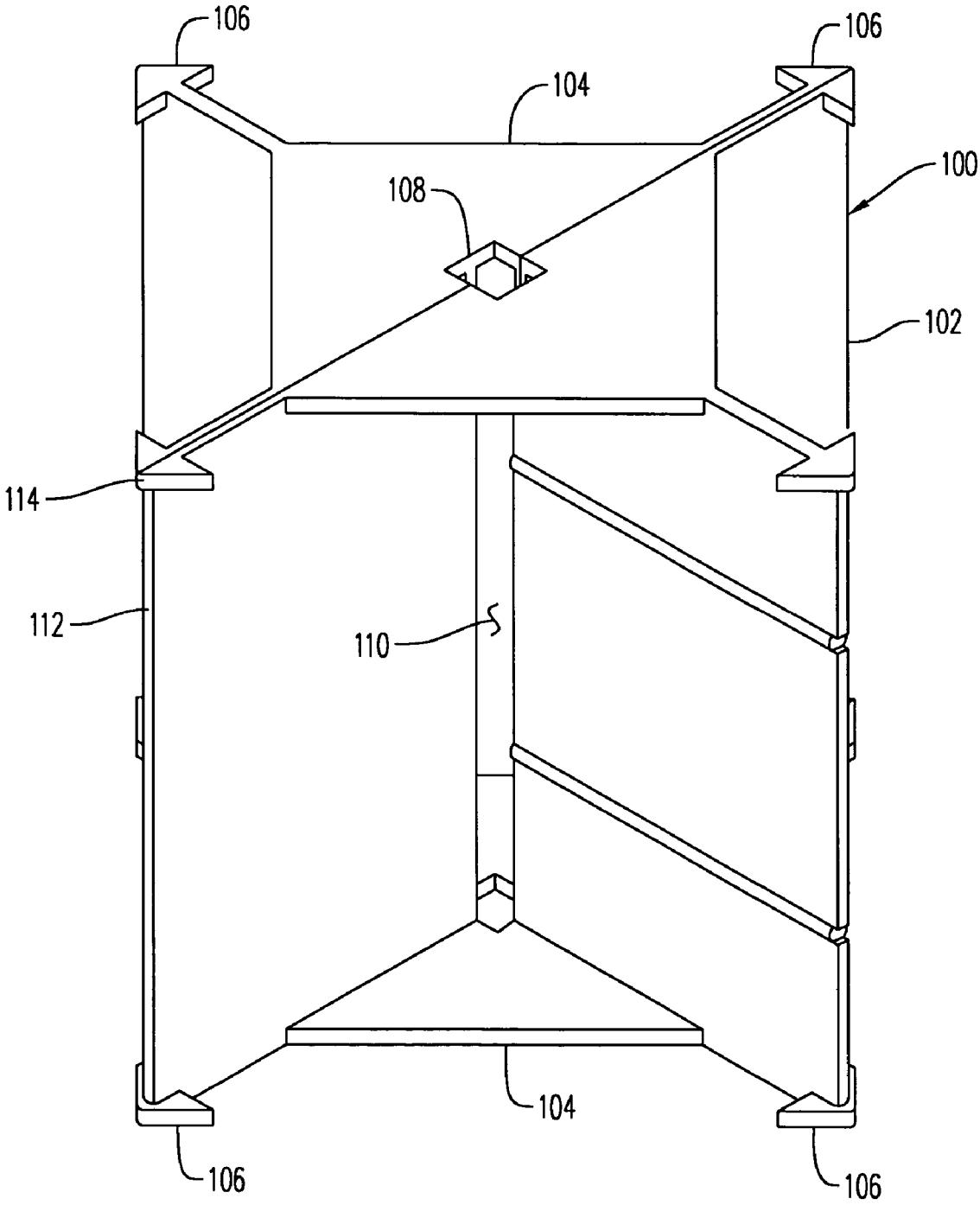
FIG. 9 is a perspective view of yet another embodiment of the invention.
Figure 10:
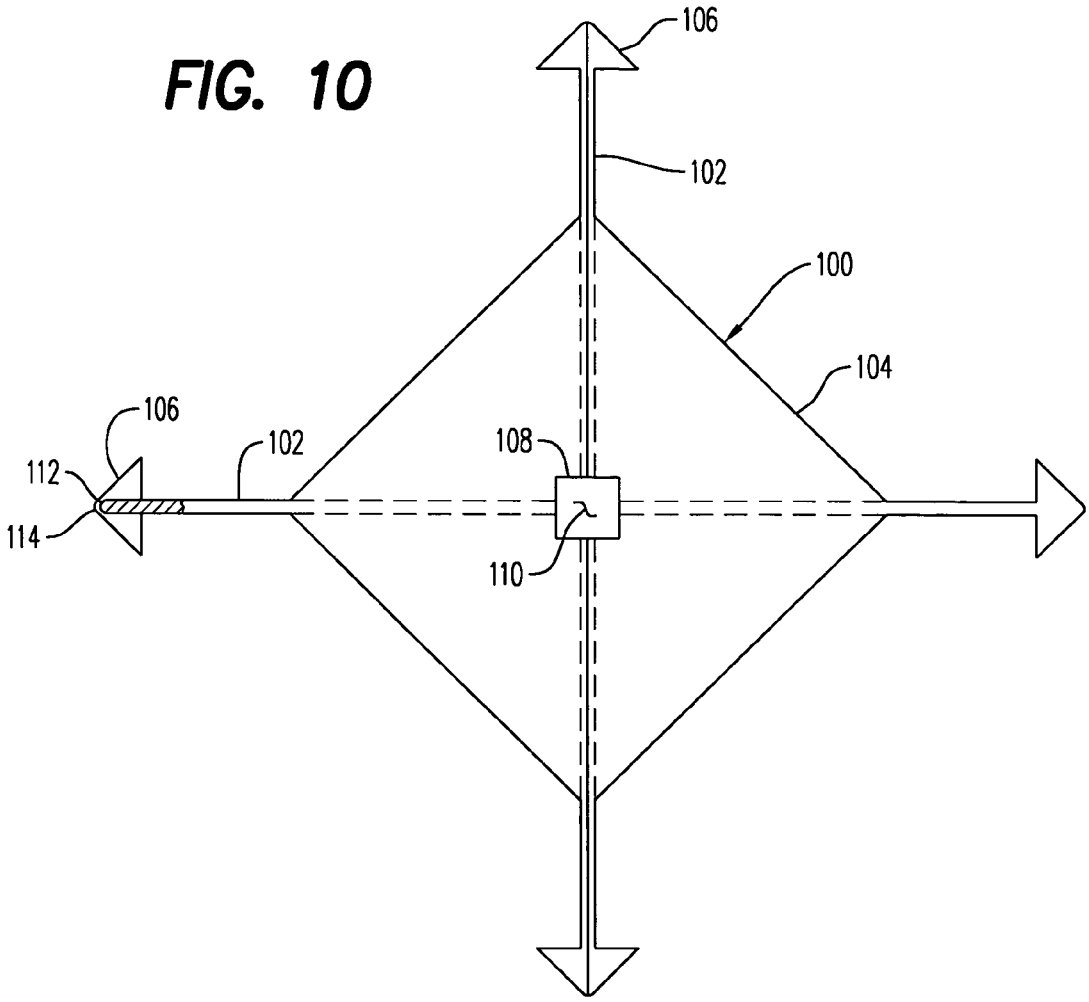
FIG. 10 is a top plan view of FIG. 9.

Still another embodiment of the magazine of the invention is shown generally at numeral 100 in FIGS. 9 and 10. In this embodiment 100 of the magazine, similar longitudinal panels 102 are provided in orthogonal orientation one to another and strengthened in that relationship by end panels 104. These end panels 104 include drive apertures 108 for receiving a mating drive shaft which slidably engages through a longitudinally extending a longitudinally extending clearance passage 110.

To insure that the flexible rivet carrying strip (not shown in these drawings) is prevented from slipping off of the distal edges 112 of each of the longitudinal panels 102, overhang tabs 106 are also provided which extend radially outwardly at 114 a distance sufficient to prevent slippage of the flexible rivet carrying strip therefrom.

Figure 11:
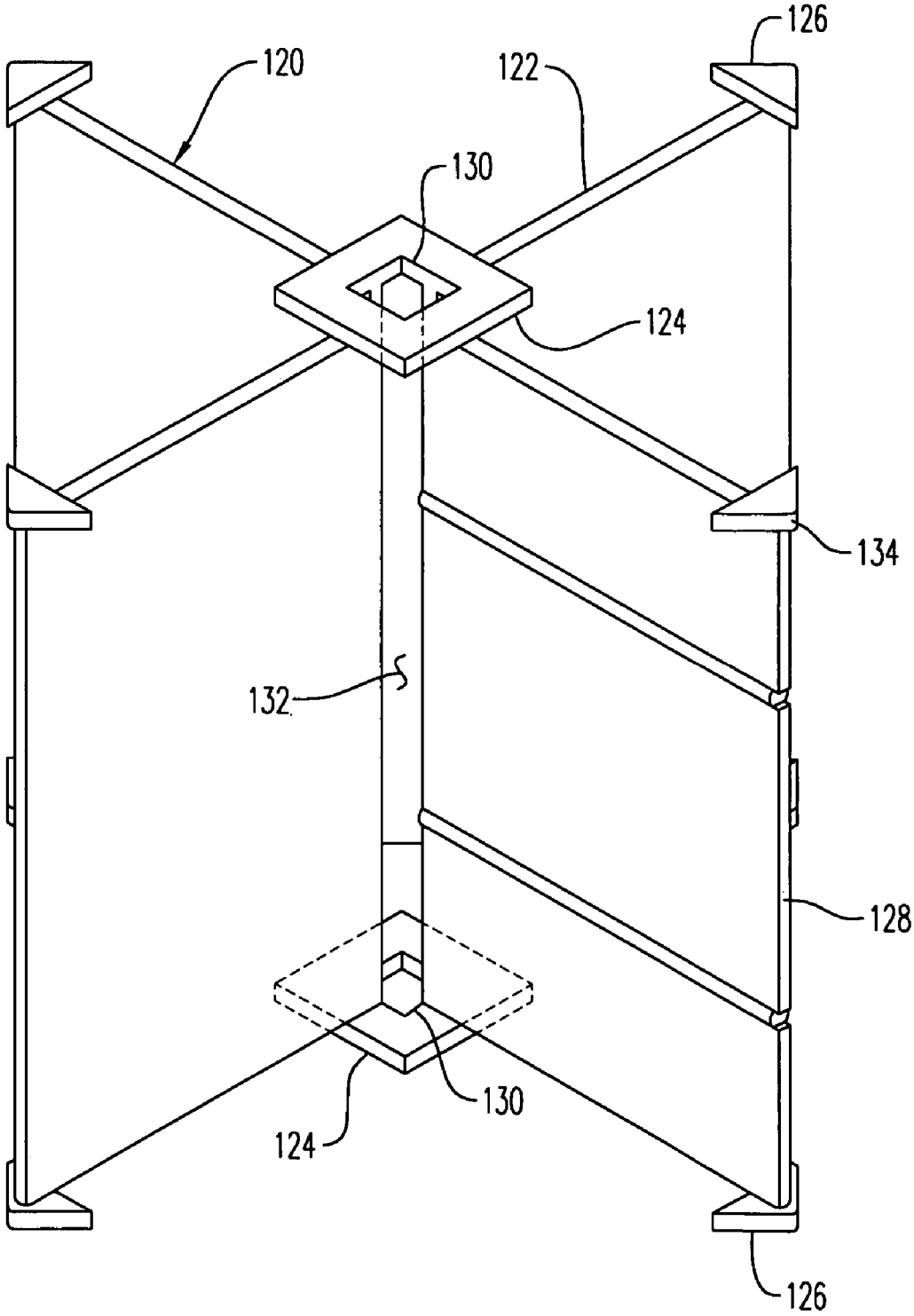
FIG. 11 is a perspective view of still another embodiment of the invention.
Figure 12:
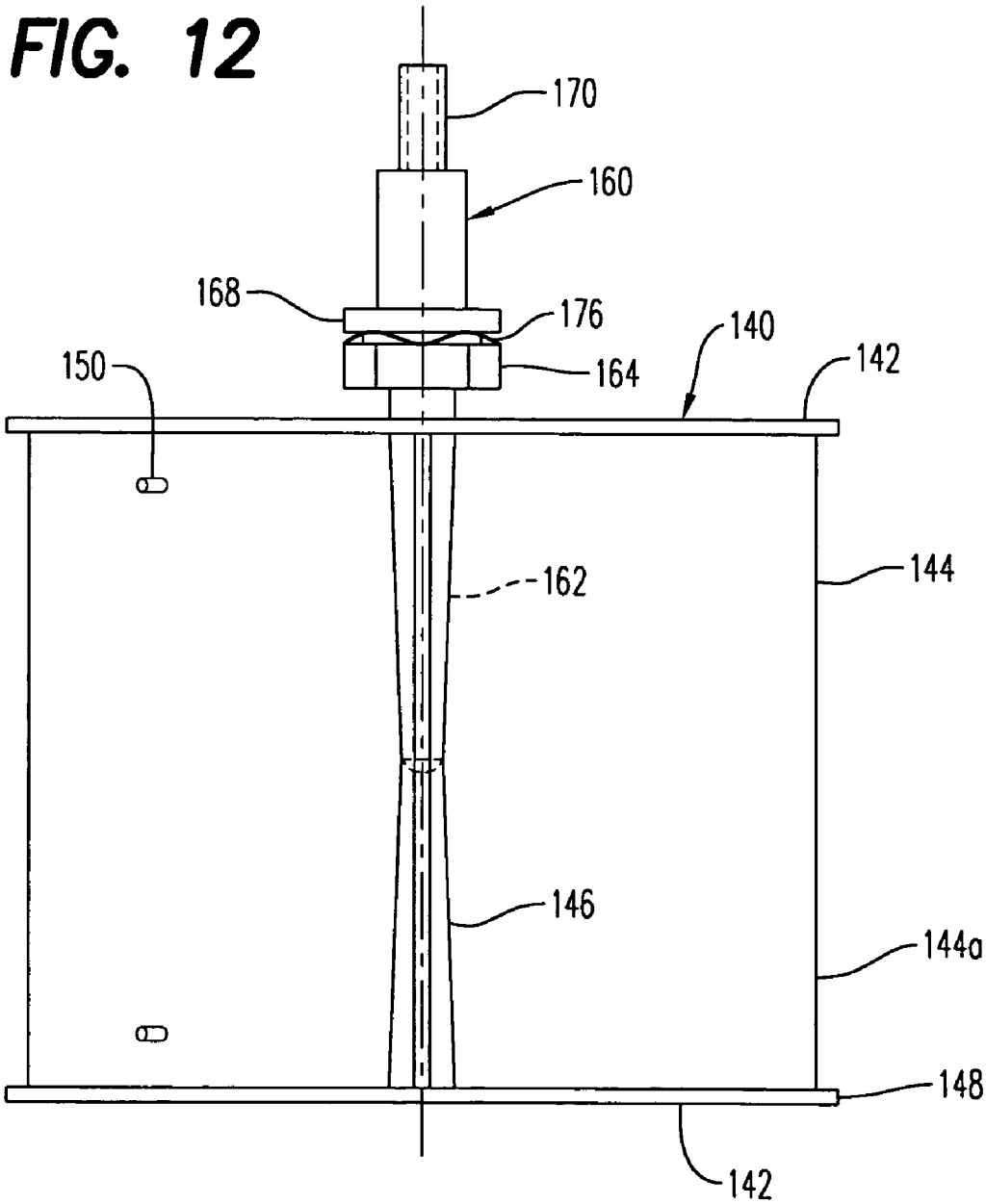
FIG. 12 is a front elevation view of the preferred embodiment of the invention showing the support shaft releasably attached thereto.
Figure 13:
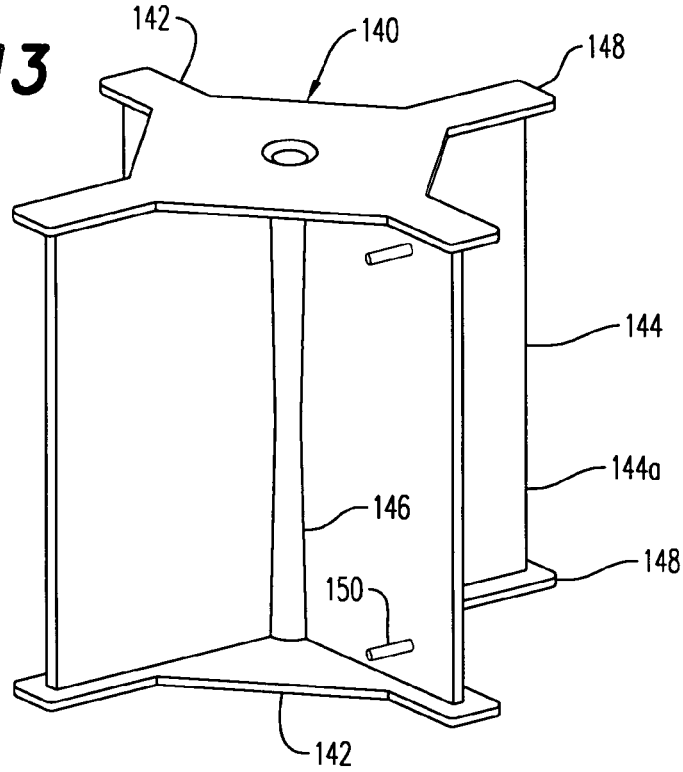
FIG. 13 is a perspective view of FIG. 12.

In FIG. 11, still another yet more economical embodiment of the magazine of the invention is there shown generally at numeral 120. In this embodiment 120, longitudinally extending longitudinal panels 122 orthogonally oriented one to another and radially extending about an imaginary center line of the magazine as with respect to all of the other embodiments described hereinabove, are also provided. A small stabilizing end panel 124 is disposed centrally against each end margin of the longitudinal panels 122, the entire magazine 120 being formed as a unit of molded plastic material. A drive aperture 130 is disposed in each of the end panels 124 in alignment with a central passageway 132 while radially extending overhang tabs 126 providing a slight overhang at 134, prevent the flexible rivet-carrying strip from sliding from its wound positioning around the distal longitudinal edges 128 of each of the longitudinal panels 122.

Note in this embodiment 120 that the reinforcing end panels 124 are only for providing a drive aperture 130 and for reinforcing the orientation of the end panels 122 so that they do not substantially flex when the loaded flexible rivet-carrying strip is wound therearound. That is to say that the stability of the rivets held between each adjacent longitudinal panel 122 is maintained and the rivet heads are kept from substantial movement outside of the end profile of the magazine 120 by the biased effect of the rivets against the side walls of the longitudinal panels 122 created by the flexing of the flexible rivet-carrying strip by the biasing of the entire rivet against the sides of each of the longitudinal panels 122 as previously described.

Figure 14:
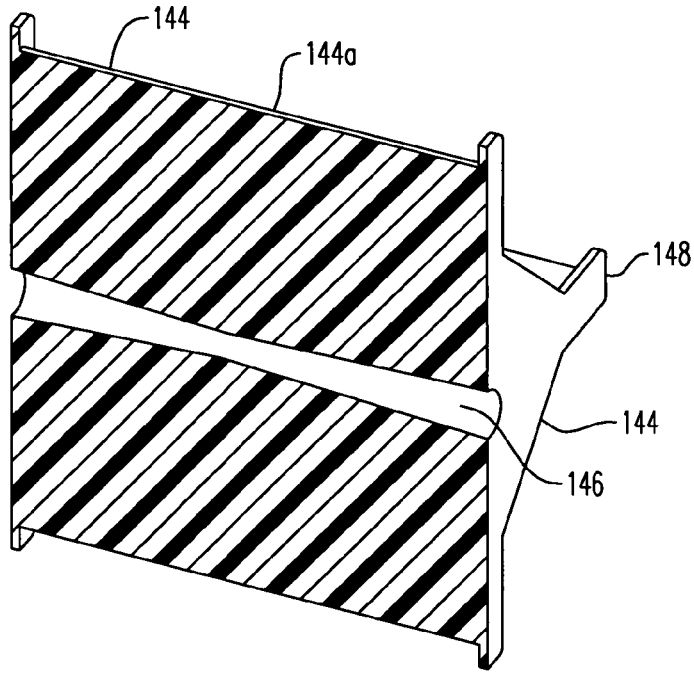
FIG. 14 is a longitudinal section view of FIG. 13.

Referring now to FIGS. 12 to 17, the preferred embodiment of the magazine is there shown generally at numeral 140 formed as a single molded plastic unit including four longitudinal panels 144 longitudinally extending between transverse end plates 142 thereof. An elongated longitudinally extending central passageway 146 is tapered toward the central portion thereof as best seen in FIG. 14 to accommodate and to releasably, yet lockingly engage onto a support shaft 160 which is described more fully herebelow.

Figure 15:
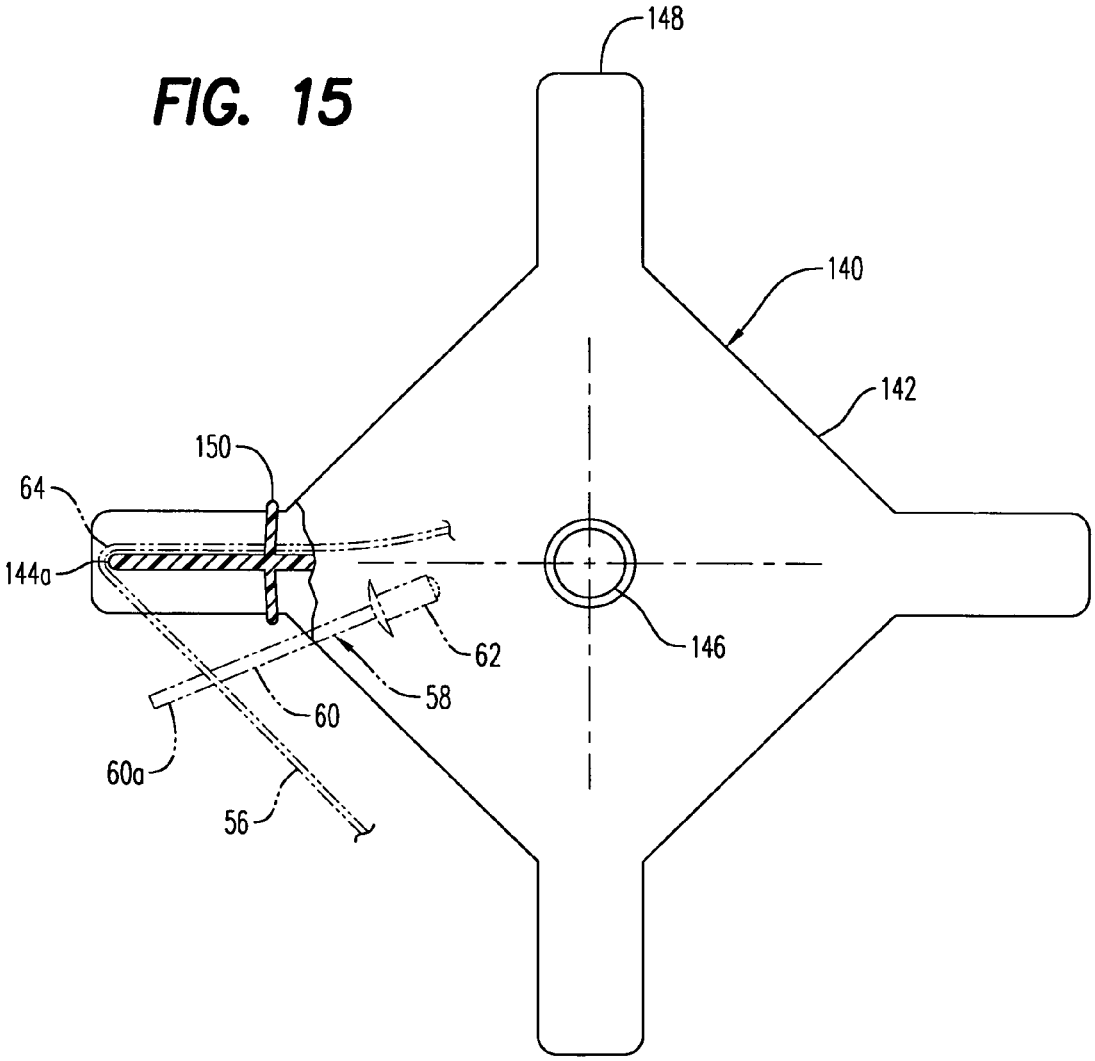
FIG. 15 is a top plan broken view of FIG. 13 showing a distal lead portion of the rivet carrying strip and rivet attached thereto in phantom.

To insure that the MYLAR carrying strip 56 shown in phantom in FIG. 15 carrying rivets 58 does not slip from its wound ready-for-use position around each longitudinally extending edge 144*a* of each of the panels 144, each the distal end portions 148 of each of the end panels 142 extend radially slightly beyond the corresponding edge 144*a*.

As best seen in FIG. 15, this embodiment 140 also includes molded elongated slender carrying strip attaching pins 150 which are positioned on and extend at a slight inward angle to tangent from at least one of the panels 144. These pins 150 are positioned in close proximity to one or both of the end panels 142 and at a specified distance radially inwardly from the corresponding longitudinal distal edge 144*a*. Pin 150 is sized to be snuggly inserted into an empty aperture formed into the lead portion of the carrying strip 156 which is then pulled taught at 64 to bend around the distal edge 144*a* to begin the carrying strip winding process of loading the rivets 60 onto the magazine 140. By slightly tipping the pins 150 inwardly, a self-locking benefit is derived when the carrying strip wrapping process begins. In this embodiment 140, the transverse perimeter measurement around the distal edges is about 12¾" so that the rivet spacing on the carrying strip is about 1.9"

Figure 16:
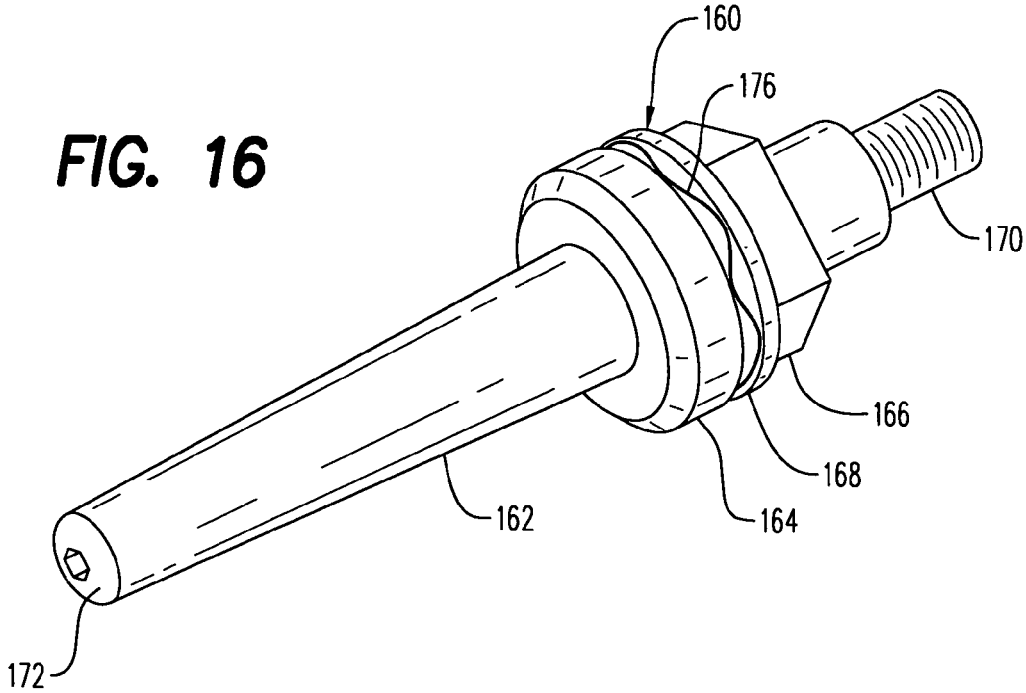
FIG. 16 is a perspective view of the magazine support shaft.

The support shaft 160 is best seen in FIGS. 16 and 17 and is formed in two main rigid components, a tapered outer shaft 162 and an inner shaft 174. The outer shaft 162 matches the tapered passageway 146 best seen in FIG. 14 and is of sufficiently shallow angle of taper so as to be self-locking when tapped into the position shown in FIG. 12. However, to further insure the releasable attachment to avoid inadvertent disengagement between the support shaft 160 and the magazine 140 when in use, a machined micro finish of 125 microns is applied to the outer surface of the outer member 162 for additional frictional engagement into the tapered passageway 146. Note that other forms of surface finishing such as bead blasting, knurling and the like may be applied for this enhanced releasable attachment feature.

The inner shaft 174 is held in position by a threaded fastener 172 which exerts pressure against a spring or crush washer 176 positioned between an enlarged head 164 of the outer shaft 162 and an enlarged flange 168 of the inner shaft 174. By this arrangement, by adjusting the tightness of threaded fastener 172, which variably compresses the spring washer 176, relative resistance to frictional rotation between the outer tapered member 162 and the threaded proximal end 170 which remains stationary and locked into the rivet setting tool is accomplished. The threaded proximal end 170 threadably engages into a mating female thread formed into a side portion of the rivet setting tool housing as described in U.S. Pat. No. 5,136,873 which has previously been incorporated by reference to support the magazine 140.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A one-piece magazine mold formed as a unit for holding a quantity of blind rivets ready for use in an automatic rivet setting tool, the quantity of rivets connected together in spaced relation along the length of an elongated rivet carrying strip of thin flexible material by having a distal portion of a mandrel of each rivet inserted or pierced therethrough, said magazine comprising:

a plurality of longitudinal generally flat, rectangular panels molded together as a single unit in an evenly spaced, radially extending arrangement about a longitudinal axis extending along a central passageway defined by a convergence of said panels and forming a spool;

said plurality of longitudinal panels each defining an outer distal longitudinal edge thereof, all of said distal edges being substantially parallel one to another and to said longitudinal axis;

whereby each rivet of the quantity of rivets carried on the flexible strip, when the flexible strip is spiral-wound around said longitudinal distal edges, being positioned in somewhat radially oriented fashion between adjacent said longitudinal panels, a head of each rivet being positioned inwardly toward said longitudinal axis;

an overhang tab positioned at each outer distal corner of each of said longitudinal panels whereby the flexible strip spiral wound around said distal edges is retained from inadvertent displacement from the ends of said panels.

2. A magazine as set forth in claim 1, wherein a lead aperture is formed adjacent a distal lead portion of the carrying strip, said magazine further comprising:

a carrying strip attaching pin extending laterally from one said panel and being positioned adjacent to one outer corner and said distal edge of said panel;

said attaching pin releasably insertable through the lead aperture of the carrying strip whereby the carrying strip and rivets attached thereto may be wound onto said magazine.

3. A magazine as set forth in claim 2, further comprising:

an elongated support shaft having a proximal end thereof adapted for supportive attachment in a laterally extending orientation to the rivet setting tool;

a main distal portion of said support shaft releasably engageable in self-locking fashion into said central passageway whereby said magazine holding the rivet carrying strip and rivets thereon is held for limited rotation about the longitudinal axis as each rivet carried on the carrying strip is fed into a nosepiece of the rivet setting tool.

4. A magazine for holding a quantity of blind rivets ready for use in an automatic rivet setting tool, the quantity of rivets connected together in spaced relation along the length of an elongated rivet carrying strip of thin flexible material by having a distal portion of a mandrel of each rivet inserted therethrough, said magazine comprising:

a plurality of longitudinally extending generally flat panels molded together as a single unit in a spaced, radially extending arrangement about a longitudinal axis defined by an elongated central passageway defined by a convergence of said panels and between spaced parallel end plates forming a spool;

said plurality of longitudinal panels each defining an outer distal longitudinal edge thereof, all of said distal edges being substantially parallel one to another;

whereby each rivet of the quantity of rivets carried on the flexible strip, when the flexible strip is spiral-wound around said longitudinal distal edges, being positioned in somewhat radially oriented fashion between adjacent said longitudinal panels, a head of each rivet being positioned inwardly toward a central axis of the spool when said flexible strip is wound in spiral fashion around said distal edges;

each end plate of said pair of end plates extending radially outwardly a short distance beyond each of said distal edges to form an overhang tab whereby the flexible strip spiral wound around said distal edges is retained from inadvertent movement from any of said distal edges.

5. A magazine as set forth in claim 4, wherein a lead aperture is formed adjacent a distal lead portion of the carrying strip, said magazine further comprising:

a carrying strip attaching pin extending from one said panel and being positioned adjacent to one outer corner and said distal edge of said panel;

said attaching pin releasably insertable through the lead aperture of the carrying strip whereby the carrying strip and rivets attached thereto may be wound onto said magazine.

6. A magazine as set forth in claim 5, further comprising:

an elongated support shaft having a proximal end thereof adapted for supportive attachment in a laterally extending orientation to the rivet setting tool;

a main distal portion of said support shaft releasably engageable in self-locking fashion into said central passageway whereby said magazine holding the rivet carrying strip and rivets thereon is held for limited rotation about the longitudinal axis as each rivet carried on the carrying strip is fed into a nosepiece of the rivet setting tool.

7. A magazine formed as a unit for holding a quantity of blind rivets ready for use in an automatic rivet setting tool, the quantity of rivets connected together in spaced relation along the length of an elongated rivet carrying strip of thin flexible material by having a distal portion of a mandrel of each rivet inserted therethrough, said magazine comprising:

a plurality of longitudinally extending generally flat panels connected together in a spaced, radially extending arrangement about a central passageway defined by a proximal longitudinal edge and between a pair of spaced parallel end plates forming a spool;

each end plate of said pair of end plates having a central drive aperture adapted to receive an elongated support shaft operably engageable through said drive aperture and said passageway;

said plurality of longitudinal panels each defining an outer distal longitudinal edge thereof, all of said distal edges being substantially parallel one to another;

whereby each rivet of the quantity of rivets carried on the flexible strip, when the flexible strip is spiral-wound around said longitudinal distal edges, being positioned in somewhat radially oriented fashion between two adjacent said longitudinal panels, a head of each rivet being positioned inwardly toward a central axis of the spool;

an overhang tab positioned at each outer distal corner of each of said longitudinal panels whereby the flexible strip spiral wound around said distal edges is retained from inadvertent displacement therefrom.

8. A magazine as set forth in claim 7, wherein a lead aperture is formed adjacent a distal lead portion of the carrying strip, said magazine further comprising:

a carrying strip attaching pin extending laterally from one said panel and being positioned adjacent to one outer corner and said distal edge of said panel;

said attaching pin releasably insertable through the lead aperture of the carrying strip whereby the carrying strip and rivets attached thereto may be wound onto said magazine.

9. A magazine as set forth in claim 8, further comprising:

an elongated support shaft having a proximal end thereof adapted for supportive attachment in a laterally extending orientation to the rivet setting tool;

a main distal portion of said support shaft releasably engageable in self-locking fashion into said central passageway whereby said magazine holding the rivet carrying strip and rivets thereon is held for limited rotation about the longitudinal axis as each rivet carried on the carrying strip is fed into a nosepiece of the rivet setting tool.

* * * * *